US009248493B2

(12) United States Patent
Rabinovich et al.

(10) Patent No.: US 9,248,493 B2
(45) Date of Patent: Feb. 2, 2016

(54) FORGE PRESS, DIE AND TOOLING DESIGN WITH DISTRIBUTED LOADING

(75) Inventors: Albert Rabinovich, West Hartford, CT (US); John Richard Palitsch, Vernon, CT (US); Vincent Joseph Rovinski, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 1122 days.

(21) Appl. No.: 13/173,876

(22) Filed: Jun. 30, 2011

(65) Prior Publication Data

US 2013/0000374 A1 Jan. 3, 2013

(51) Int. Cl.
*B21J 13/03* (2006.01)
*B21K 3/04* (2006.01)

(52) U.S. Cl.
CPC ... *B21J 13/03* (2013.01); *B21K 3/04* (2013.01)

(58) Field of Classification Search
CPC ..... B21J 13/03; B21K 3/04; B21K 1/30; B30B 15/02
USPC ..... 72/352, 357, 360, 396, 397, 455, 465.1, 72/466
See application file for complete search history.

(56) References Cited

U.S. PATENT DOCUMENTS

| | | | | | |
|---|---|---|---|---|---|
| 1,142,419 | A | * | 6/1915 | Hansen | 72/325 |
| 1,823,557 | A | * | 9/1931 | Bowen | 72/397 |
| 2,544,447 | A | * | 3/1951 | Dodds | 72/396 |
| 4,984,445 | A | * | 1/1991 | Ohuchi et al. | 72/360 |
| 5,106,012 | A | * | 4/1992 | Hyzak et al. | 228/265 |
| 7,047,787 | B2 | * | 5/2006 | Kanemitsu et al. | 72/355.4 |

FOREIGN PATENT DOCUMENTS

| | | | | |
|---|---|---|---|---|
| CA | 1075505 | * | 9/1976 | 78/39 |
| FR | 2365387 | A1 | 4/1978 | |
| JP | J132005131680 | A | 5/2005 | |

OTHER PUBLICATIONS

The extended European Search Report of counterpart European Application No. 12170350.8 filed May 31, 2012.

* cited by examiner

*Primary Examiner* — David Bryant
*Assistant Examiner* — Lawrence Averick
(74) *Attorney, Agent, or Firm* — Kinney & Lange, P.A.

(57) ABSTRACT

A forging die and tooling stack consist of a top and bottom die set positioned on a pusher plate in a die holder. Prior art die and tooling stack designs with rectangular axial cross sections concentrated loading toward the radial center of the stack. By contouring the top surface of the pusher plate and the bottom surface of the die holder, loading at the bottom of the stack can be redistributed to reduce non-uniform loading of components beneath the stack in the load train.

17 Claims, 8 Drawing Sheets

FORGE PRESS, DIE AND TOOLING DESIGN WITH DISTRIBUTED LOADING

BACKGROUND

Press forging is a preferred method of forming nickel and cobalt based superalloys into gas turbine components such as rotors, disks, and hubs. As expected, forging loads required to produce the superalloy components are high and can exceed 30 kilotons. In many instances, forging part geometries are such that non-uniform loading is experienced in the structural components of a forging press, in the associated tooling and in the dies themselves. The non-uniform loading can cause internal stress concentrations that can result in press component failure and that can otherwise limit the loading capacity of the press. Prior art solutions to non-uniform loading of press components include the insertion of bulk structural components in the load train to reinforce vulnerable components.

A method to address loading non-uniformity in the load train and die stack in a forging press is needed to extend and protect the life of the press.

SUMMARY

A forging die stack includes a top and bottom die set positioned in a die holder. Non-uniform forging part geometries result in non-uniform loading of the structural components below the die stack and can result in press component failure or limited press capacity. The design of the pusher plate and bottom die design decrease load.

DETAILED DESCRIPTION

Non-uniform work piece cross sections during forging can result in non-uniform loading of the dies and other components of the load train in a forging press. This loading asymmetry can result in shortened die press component life, limited forging capacity of the press, and mechanical failure of the dies and other tooling. Prior art solutions to this problem have been to increase the structural rigidity of the load train, where necessary, by adding heavy structural reinforcement in the form of plates to relieve stress concentrations in vulnerable components. This "brute force" approach has been insufficient in a number of applications. The present invention offers a solution to non-uniform stress distribution by redistributing stresses in the load train of a tooling stack by changing the geometrical profile of specific tools in the stack.

Figure 1:
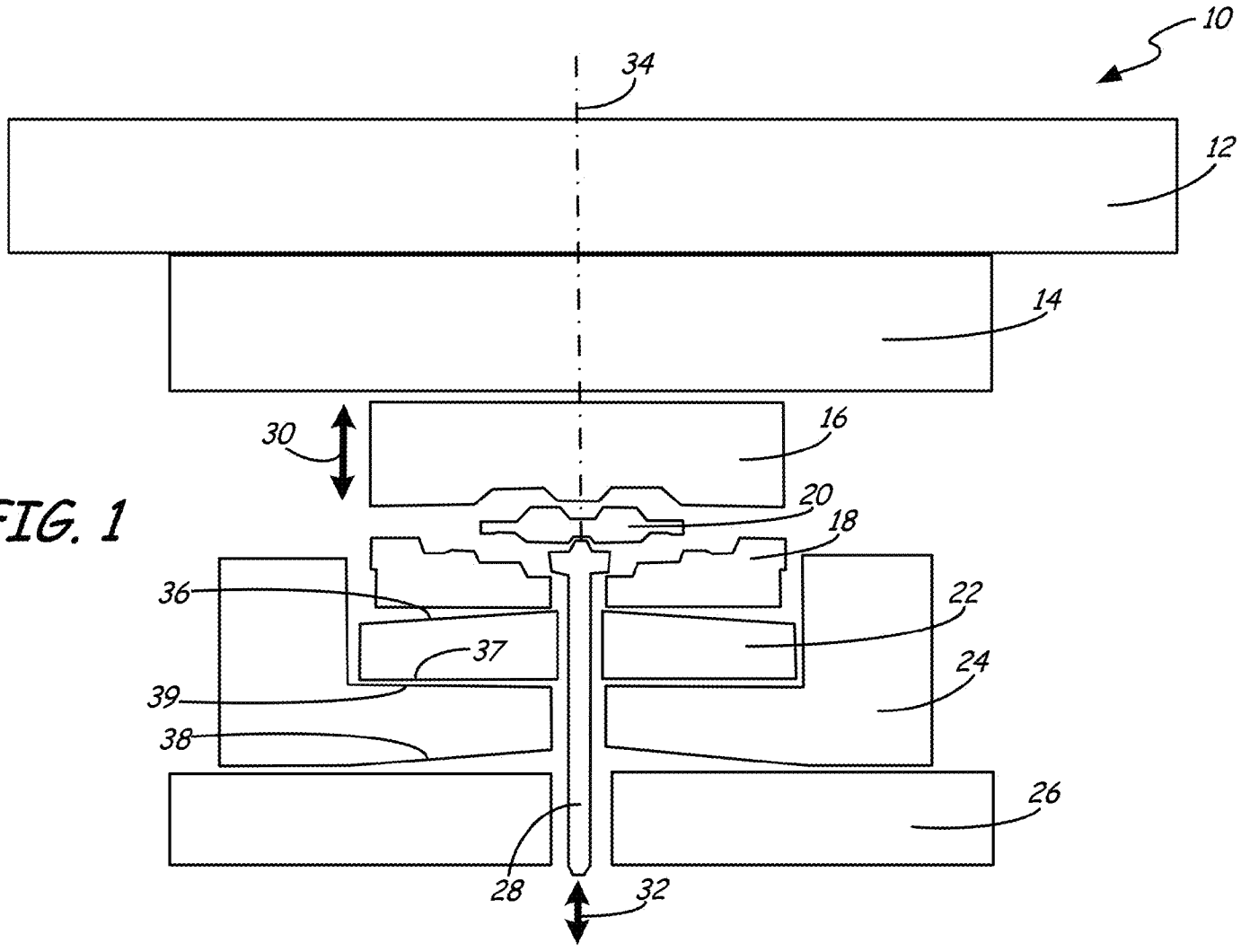
FIG. 1 is a schematic showing a cross sectional view of the die set tooling stack and press setup for forging a high pressure superalloy turbine disk.

A schematic illustrating cross section of exemplary forging setup 10 is shown in FIG. 1. Although forging setup 10 is shown as forging high temperature superalloy turbine disk 20, the setup is to be taken as general and, with modifications known to those in the art, the invention taught herein can be applied to any forging process. Forging setup 10 comprises press top 12 attached to top bolster 14 attached to a ram of a hydraulic press, not shown, capable of applying pressure to press top 12 and top bolster 14 by moving in an axially downward direction as shown by arrow 30. Press top 12 and top bolster 14 are also capable of upward motion as also shown by arrow 30. A die set comprising cylindrical upper die 16 and cylindrical lower die 18 is positioned on cylindrical pusher plate 22 in die holder 24. Upper die 16 is attached to top bolster 14. High temperature superalloy turbine disk 20 is shown in the cavity between upper die 16 and lower die 18. When forging is complete, turbine disk 20 conforms exactly to the interior shape of the cavity in the die set. The die and tooling stack comprising upper and lower dies 16 and 18, pusher plate 22, and die holder 24 sit on bottom bolster 26. Bottom bolster 26 sits on the press bottom, not shown, containing, for instance, test and control equipment.

During operation, press top 12 moves downward to forge disk 20. Following forging, press top 12, top bolster 14, and top die 16 move upward to allow forging 20 to be removed. Forging 20 is removed by knock out fixture 28 which moves in an upward direction indicated by arrow 32 along center line 34 to eject forging 20 from lower die 18.

The invention is shown in FIG. 1 as conical surfaces with radial tapers 36 and 38 of the top surface of pusher plate 22 and bottom surface of die holder 24, respectively. In taper 36, the top surface of pusher plate 22 moves axially downward in an outward radial direction moving away from center line 34. In taper 38, the bottom surface of die holder 38 moves axially downward in an outward radial direction moving away from center line 34. The combination of the two tapers redistributes the internal stress on bottom bolster 26 and all components beneath bottom bolster 26 in radial directions away from the center of the bottom bolster, thereby relieving the stress on the components. In an embodiment, taper 38 may be on bottom 37 of tool holder 24 such that the top and bottom surfaces of pusher plate 22 comprise conical surfaces with radial tapers. In another embodiment, conical taper 36 on the top of pusher plate 22 may be on top surface 39 of die holder 24.

Finite element analysis was used to validate the invention. In the analysis, the internal distribution of Von Mises equivalent stresses and vertical axial stresses in bottom bolster 26 were compared under forging loads before and after conical tapers 36 and 38 were introduced in pusher plate 22 and die holder 24, respectively.

In order to determine a base line, internal stress distributions were obtained on a prior art design comprising pusher plate 22' and die holder 24' with rectangular cross sections.

Figure 2:
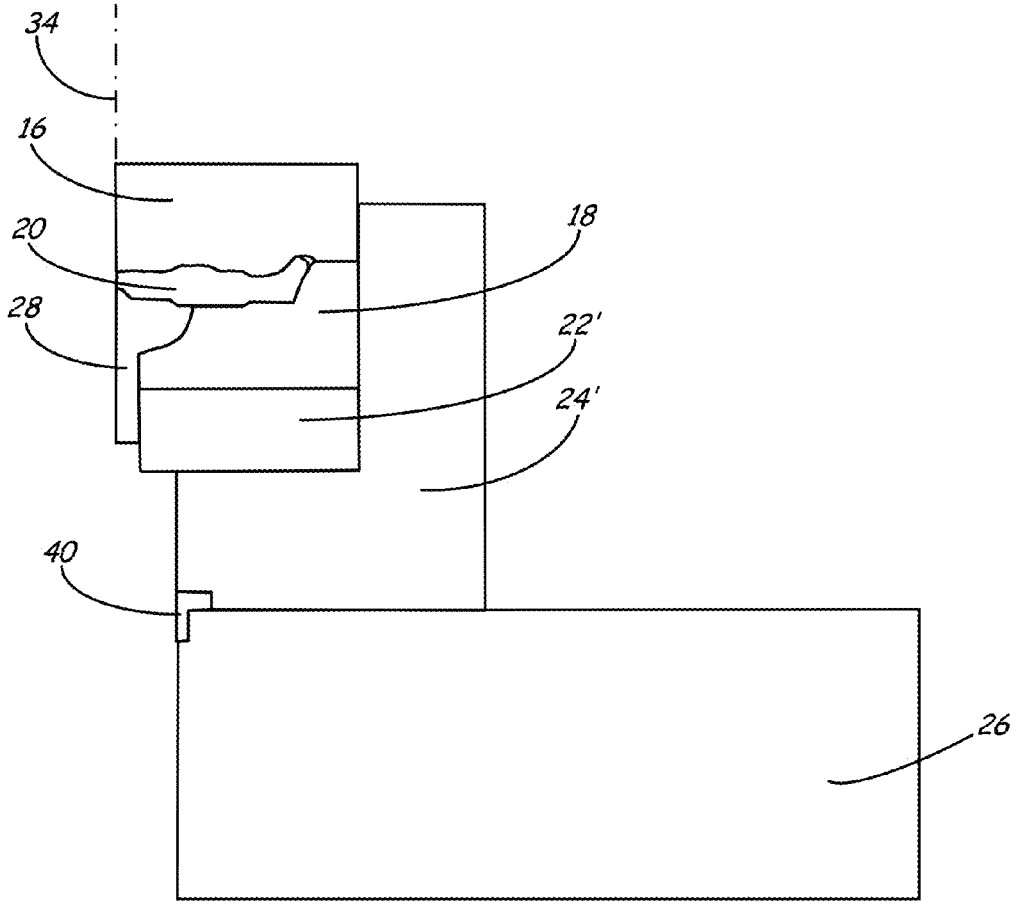
FIG. 2 PRIOR ART
FIG. 2 is a schematic cross section of the die set and tooling stack of a prior art forging design.

A schematic cross section of the prior art die, forging, and tooling stack below top bolster 14 used in the analysis is shown in FIG. 2. The cross sections of the prior art cylindrical pusher plate and die holder are shown to have rectangular cross sections. Top die 16, bottom die 18, forging 20, pusher plate 22', die holder 24', bottom bolster 26, and knock out 28 are shown as indicated. Locater ring 40 positions die holder 24' with respect to center line 34.

Figure 3:
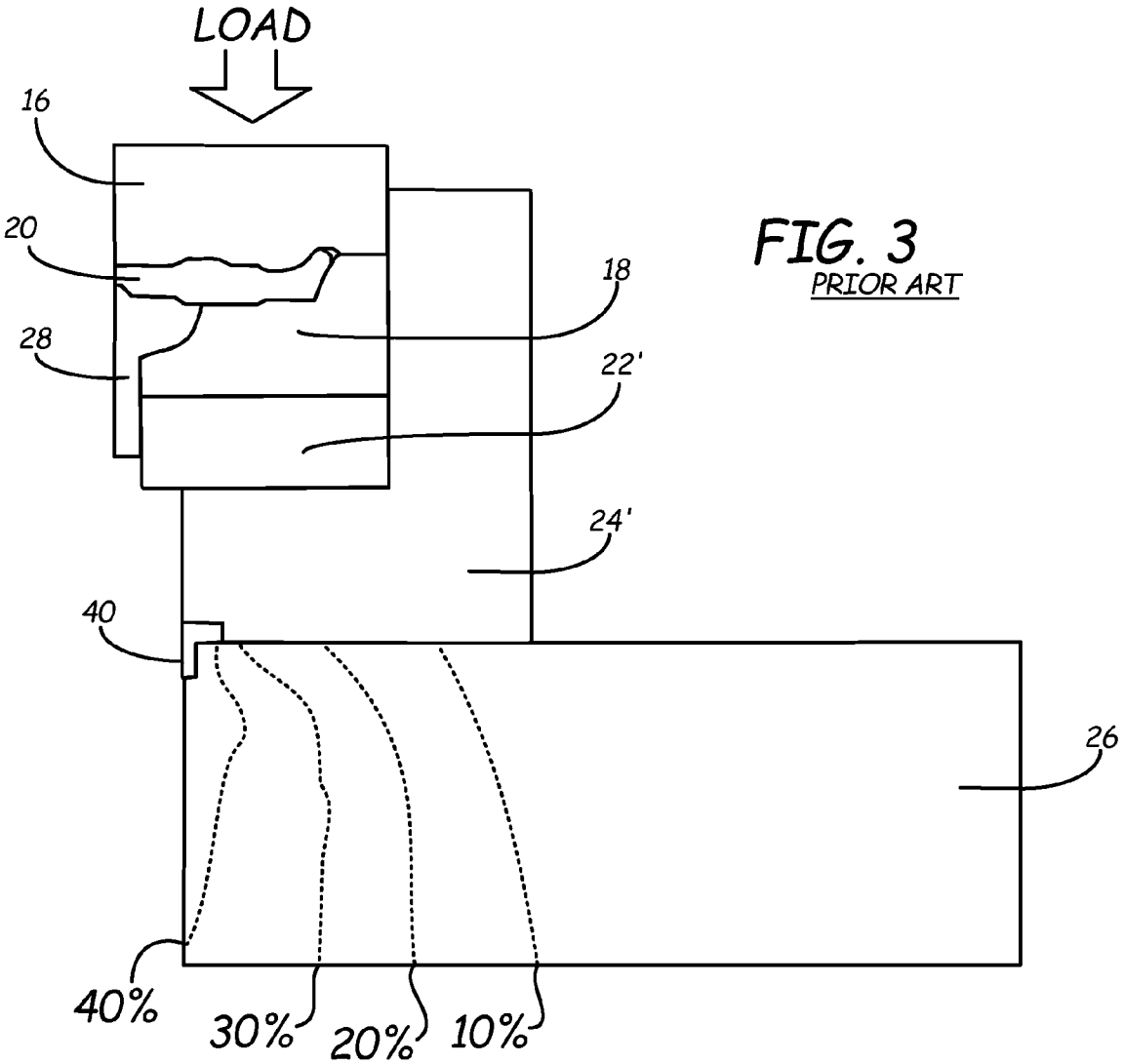
FIG. 3 PRIOR ART
FIG. 3 is an isostress plot of the Von Mises equivalent stress in the die set and tooling stack of FIG. 2 under a forging load.
Figure 4:
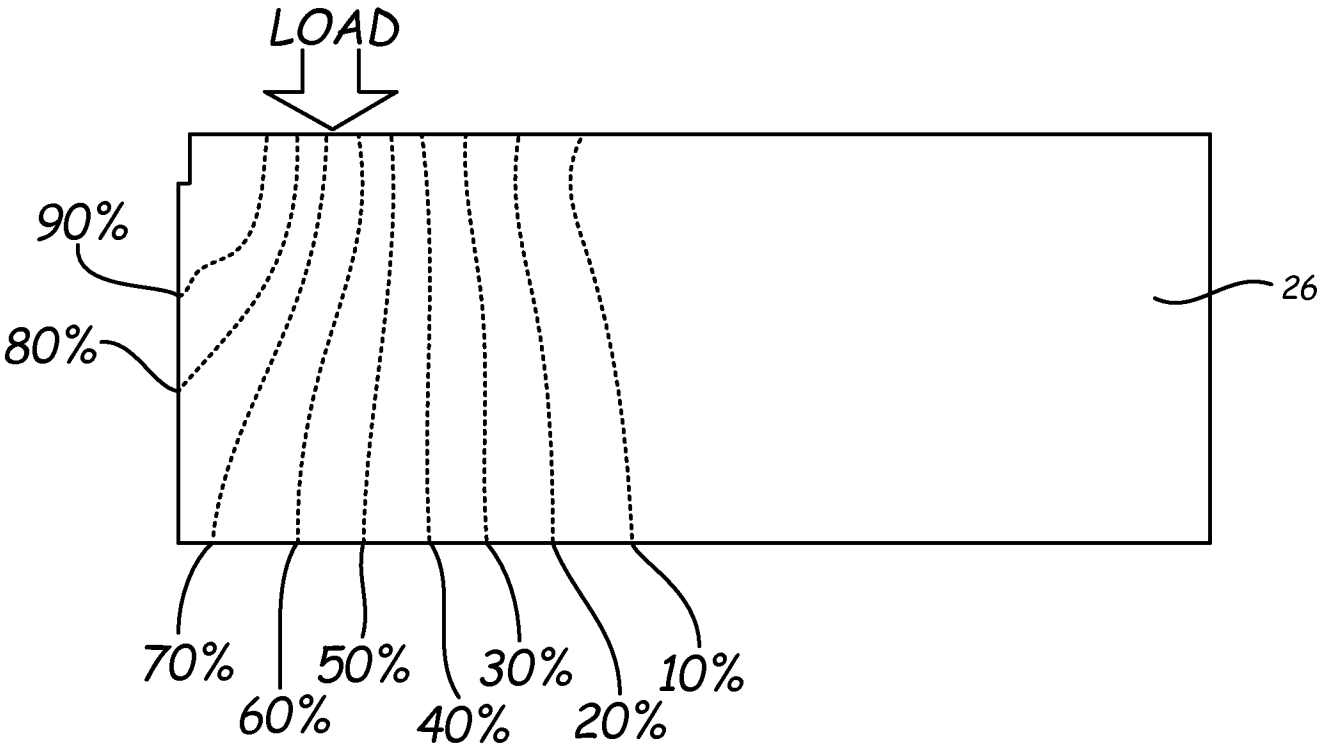
FIG. 4 PRIOR ART
FIG. 4 is an isostress plot of the axial stress in bottom bolster 24 of FIG. 2 under a 30 kiloton forging load.
Figure 5:
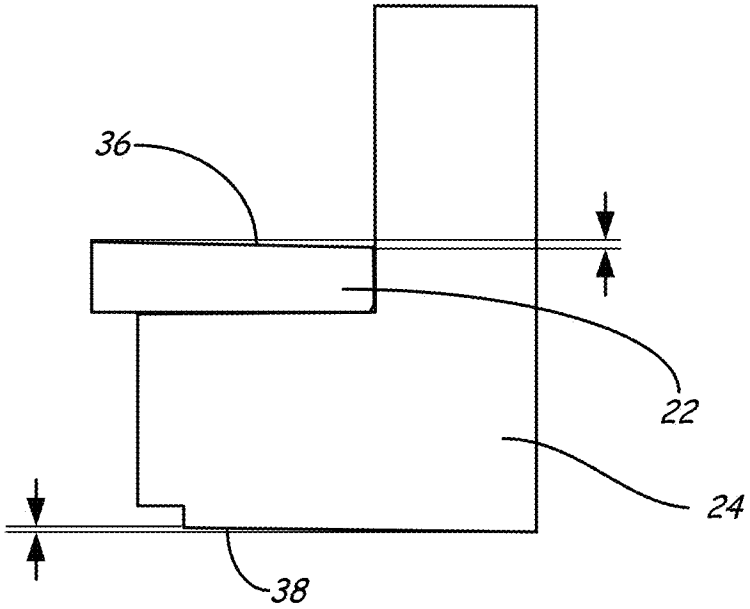
FIG. 5 is a schematic cross section of the die holder and pusher plate of the invention.

Finite element analysis techniques are well known in the art and are not described herein. In an embodiment, upper die 16, lower die 18, and disk 20 are high temperature superalloy. Bolsters 14 and 26, pusher plate 22', die holder 24', and knock out 28 are die steel. In the analysis, the dimensions, alloy material, and temperature of each component are input. Other assumptions in the finite element analysis include the following:

1. Axisymmetric model
2. Static elastic analysis with temperature dependent material properties
3. No heat transfer between components
4. Contact interfaces with bilinear friction
5. Die holder as a single unit
6. Superalloy and die steel yield stresses The equivalent stress distribution under a prior art load is shown in FIG. 3. FIG. 3 is an isostress plot with the stress of a number of isostress lines indicated on the plot. By definition, the equivalent stress is a scalar value indicative of the highest stress at any point in the body of the part. Special attention is directed at the internal stress at the bottom of bottom bolster 26. It is that stress that is transmitted to components under the bolster during forging. Only isostress lines in bottom bolster 26 are shown. The stress at the inside corner is 40% and decreases in an outward radial direction away from the corner of bottom bolster 26. The normal component of the stress field in the bolster perpendicular to the base under a load is shown in FIG. 4. By definition, this is the stress acting in a downward fashion on components beneath bottom bolster 26. The stress at the bottom interface of bottom bolster 26 is the stress that is transmitted to components beneath bottom bolster 26 during forging. The normal stress at the inside corner is about 70%. A schematic cross section of pusher plate 22 and die holder 24 in an embodiment of the invention is shown in FIG. 5. Inventive conical taper 36 on the top side of pusher plate 22 slopes linearly downward from the inside diameter of pusher plate 22 to the outside diameter of tool holder 24. Inventive conical taper 38 on the bottom of tool holder 24 slopes linearly upward inside the outer diameter of tool holder 24 to the inside diameter of tool holder 24.

Figure 6:
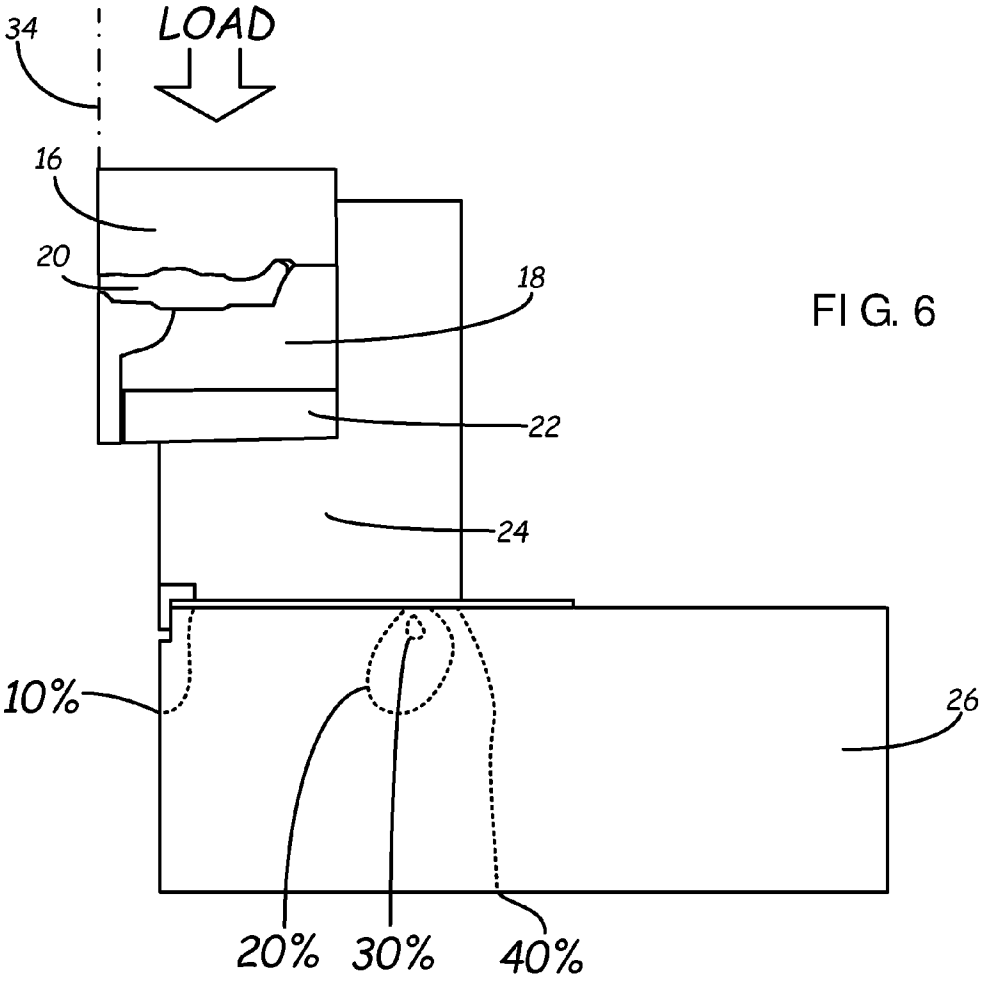
FIG. 6 is an isostress plot of the Von Mises equivalent stress in the die set and tooling stack of the invention under a forging load.

The equivalent stress distribution under a load in the die stack and tooling of the invention is shown in FIG. 6. Only isostress lines in bottom bolster 26 are shown. Special attention is directed at the internal stress at the bottom of bottom bolster 26. It is that stress that is transmitted to components under the bolster during forging. The stress ranges from 10% near the outside of bolster 26 to 20% under the inner half of the contact surface at the bottom of bolster 26. In comparison to the equivalent stress distribution of the prior art design shown in FIG. 3, the difference is noteworthy. The stress levels at the inside corner of bottom bolster 26 of the inventive die stack are about half the loading stresses of the prior art system.

Figure 7:
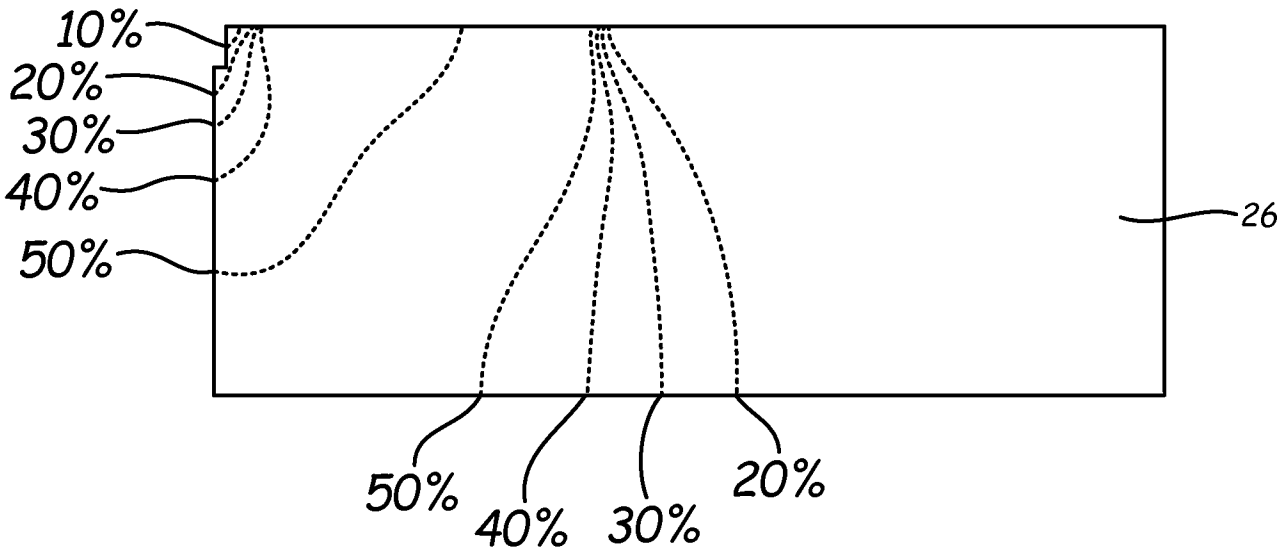
FIG. 7 is an isostress plot of the axial stress in bottom bolster 24 of the invention under a forging load.

The normal component of the stress field in bottom bolster 26 perpendicular to the base under load is shown in FIG. 7. As noted above, this is the stress acting in a downward fashion on components beneath bottom bolster 26 during forging. The stress at the inside corner of bottom bolster 26 is about 50%. In comparison to the prior art perpendicular stress levels shown in FIG. 4, the stress levels in the inside corner are reduced from about 70% to 50%.

The inventive tailoring of the tool profiles in the loading stack of the invention has redistributed the stress and decreased the transmitted loading of components beneath bottom bolster 26 by about half thereby increasing the reliability and lifetime of the load stack as well as improving the load capacity of the press.

Figure 8:
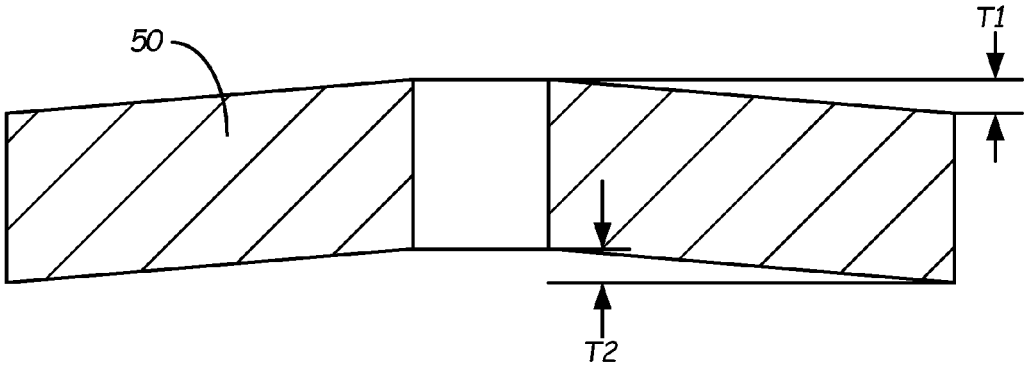
FIG. 8 is a schematic cross section of a pusher plate with conically tapered top and bottom surfaces.

The dimensional changes in pusher plate 22 and die holder 24 responsible for redistributing internal stresses in bottom bolster 26 radially outward are equivalent to inserting a radial cylinder with conical top and bottom surfaces in the bottom of the load train in a forging die stack. A cross section of radial cylinder 50 is schematically shown in FIG. 8 having top taper T1 and bottom taper T2. The slopes of T1 and T2 are exaggerated and the dimensions and material of radial cylinder 50 are to be determined depending on the requirements of a specific application. Finite element modeling to determine the optimum design of radial cylinder 50 is recommended. Tapers T1 and T2 may be linear or nonlinear and may be equal or not equal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cylindrical forging die stack comprising a top die on a bottom die on a pusher plate positioned in a die holder that is on a bottom bolster, wherein a top surface of the pusher plate confronting a flat bottom surface of the bottom die and a bottom surface of the die holder confronting a flat top surface of the bottom bolster are contoured to redistribute radial and axial internal stress distributions in the die stack to reduce loading on components beneath the die stack.

2. The die stack of claim 1, wherein the top surface of the pusher plate and the bottom surface of the die holder are contoured so that the radial and axial internal stresses are redistributed radially outward from a center toward an outside edge of the die stack.

3. The die stack of claim 2, wherein the contours of the pusher plate top surface and die holder bottom surface comprise conical surfaces with radial tapers.

4. The die stack of claim 3, wherein the radial taper of the pusher plate top surface is a positive radial taper wherein the top surface slopes downward from a central region outwardly in a radial direction toward an outer edge.

5. The die stack of claim 4, wherein the radial taper is a linear taper.

6. The die stack of claim 3, wherein the radial taper of the die holder bottom surface is a positive taper wherein the bottom surface slopes downward from a central region outwardly in a radial direction toward an outside edge.

7. The die stack of claim 6, wherein the radial taper is a linear taper.

8. The die stack of claim 1, wherein the top and bottom surfaces of the pusher plate comprise conical surfaces with radial tapers wherein the top surface has a positive radial taper that slopes downward from a central region toward an outer edge and the bottom surface has a positive radial taper that slopes downward from a central region toward an outer edge.

9. A method comprising:

positioning a work piece between a top die and a bottom die in a cylindrical die stack comprising the top die, on the bottom die, on a pusher plate, positioned in a die holder on a bottom bolster, wherein a top surface of the pusher plate confronting a flat bottom surface of the bottom die and a bottom surface of the die holder confronting a flat top surface of the bottom bolster are contoured to redistribute radial and axial internal stresses in components beneath the die stack radially outward from the center toward an outer edge of the die stack; and applying axial compressive force to the die stack to forge the work piece to a shape defined by the top and bottom dies.

10. The method of claim 9 wherein the work piece is a nickel base, cobalt base, iron base superalloy or mixtures thereof.

11. The method of claim 9 wherein the work piece is a gas turbine component.

12. The method of claim 11 wherein the work piece is a disk, or an airfoil.

13. The method of claim 9 wherein the top surface of the pusher plate and bottom surface of the die holder are contoured so that the radial and axial internal stresses are redistributed radially outward from a center toward an outside edge of the die stack.

14. The method of claim 13 wherein contours of the pusher plate top surface and die holder bottom surface comprise conical surfaces with radial tapers.

15. The method of claim 14, wherein the radial tapers are linear tapers.

16. The method of claim 14, wherein the radial taper of the pusher plate top surface is a positive radial taper wherein the surface slopes downward from a central region outwardly in a radial direction toward an outer edge.

17. The method of claim 14, wherein the radial taper of the die holder bottom surface is a positive radial taper wherein the bottom surface of the die holder slopes downward from a center region outwardly in a radial direction toward an outer edge.

* * * * *